US005272854A

United States Patent [19]

Ye et al.

[11] Patent Number: 5,272,854

[45] Date of Patent: Dec. 28, 1993

[54] PACKAGING MECHANISM

[76] Inventors: E-Fu Ye, No. 35, Lane 165, Fu Te 3rd Road, Kaohsiung; Monuago Jeng, No. 19, Alley 1, Lane 321, Chieh Shou West Road, Kang Shan Chen, Kaohsiung Hsien, both of Taiwan

[21] Appl. No.: 985,289

[22] Filed: Dec. 4, 1992

[51] Int. Cl.[5] ..... B65B 7/28; B65B 51/14; B67B 5/00

[52] U.S. Cl. ..... 53/329.2; 53/329.3; 53/329.5

[58] Field of Search ..... 53/478, 329.2, 329.3, 53/329.5, 141; 156/69

[56] References Cited

U.S. PATENT DOCUMENTS

| | | | |
|---|---|---|---|
| 3,098,916 | 7/1963 | Souligney | 53/478 X |
| 3,286,437 | 11/1966 | Cole | 53/329.3 X |
| 3,345,797 | 10/1967 | Von Stoeser | 53/478 |
| 3,378,991 | 4/1968 | Anderson | 53/478 X |
| 3,488,472 | 1/1970 | Pizarro | 53/329.3 X |
| 3,491,509 | 1/1970 | Wright | 53/478 |
| 3,505,781 | 4/1970 | Loewenthal | 53/329.3 |
| 4,035,987 | 7/1977 | Nakazato et al. | 53/329.3 X |
| 4,583,350 | 4/1986 | Artusi et al. | 53/478 |
| 4,707,213 | 11/1987 | Mohr et al. | 53/329.3 X |
| 5,182,896 | 2/1993 | Maccherone | 53/478 |

*Primary Examiner*—Horace M. Culver
*Attorney, Agent, or Firm*—Pro-Techtor International

[57] ABSTRACT

A packaging device is capable of sealing a membrane on top of a container and includes a housing, a table disposed in the housing for supporting the container, a hot-pressing device disposed above the container, and an actuating device for actuating the hot-pressing device downward and upward in order to hot-press the membrane downward toward the container. The membrane is cut after hot-pressed onto the container such that the container can be packaged automatically.

6 Claims, 6 Drawing Sheets

PACKAGING MECHANISM

BACKGROUND OF THE INVENTION (a) Field of the Invention

The present invention relates to a packaging mechanism, and more particularly to a packaging mechanism for packaging a cup or a bowl of food by hot-pressing processes.

(b) Description of the Prior Art

Food, such as noodle, bean curd etc., is contained in a container, such as a cup or a bowl, for commercial purposes, the container should be well sealed before shipping. Normally, a cover layer which is preferably made of Poly Styrene materials is fixed on top of the container for sealing the container. However, at present, the cover layer is packaged manually.

The present invention has arisen to mitigate and/or obviate the afore-described disadvantages of the conventional packaging problems.

SUMMARY OF THE INVENTION

The primary objective of the present invention is to provide a packaging mechanism which packages the cup or bowl automatically.

In accordance with one aspect of the present invention, there is provided a packaging mechanism for sealing a membrane on top of a container comprising a housing including an inlet and an outlet oppositely formed therein, a table disposed in the housing for supporting the container, the membrane entering into the housing via the inlet and leaving the housing via the outlet and located above the container, a hot-pressing means disposed above the container, and means for actuating the hot-pressing means downward and upward in order to depress the membrane downward toward the container, whereby, the membrane is hot-pressed to the top of the container when the hot-pressing means moves downward.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
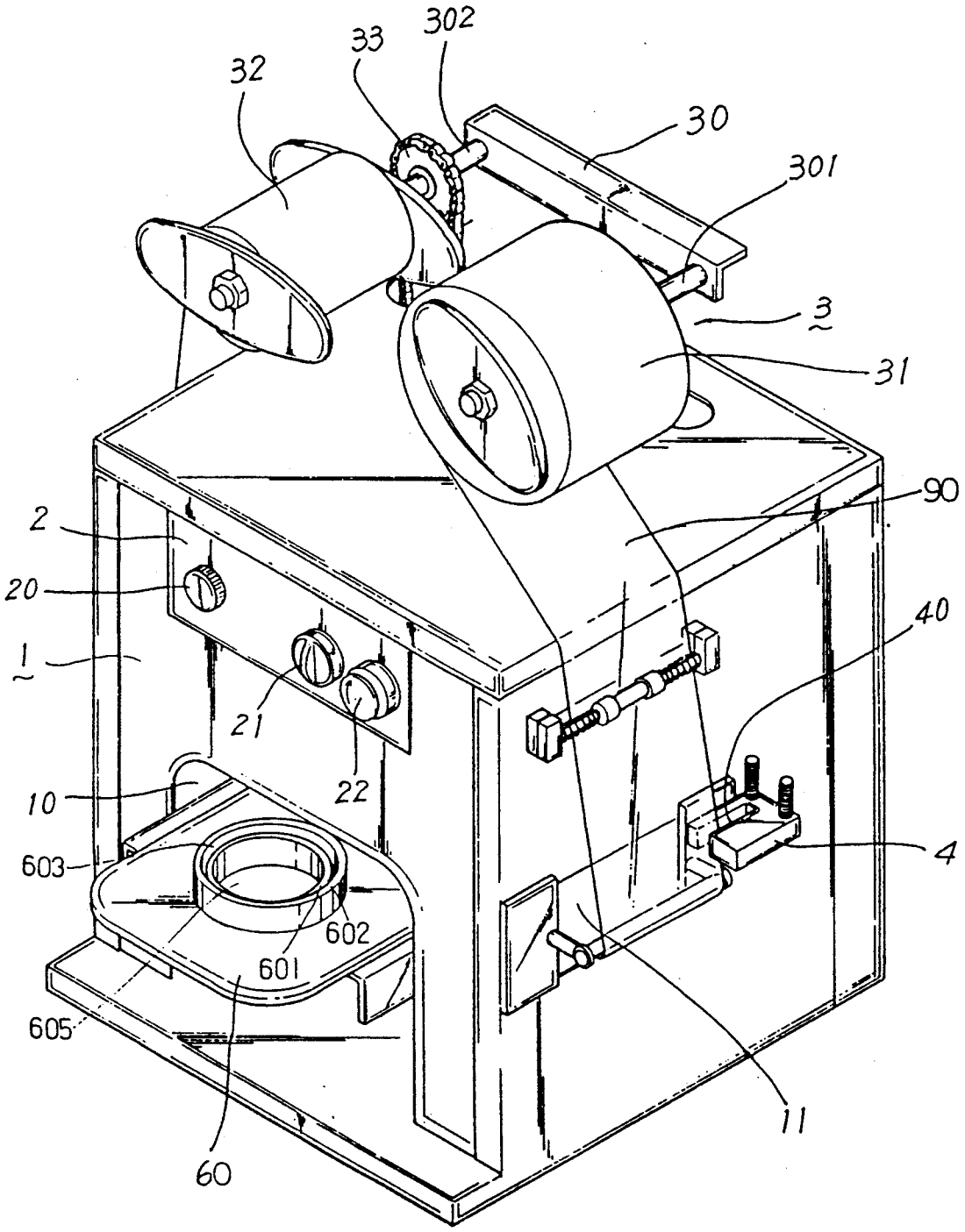
FIG. 1 is a perspective view of a packaging mechanism in accordance with the present invention.
Figure 2:
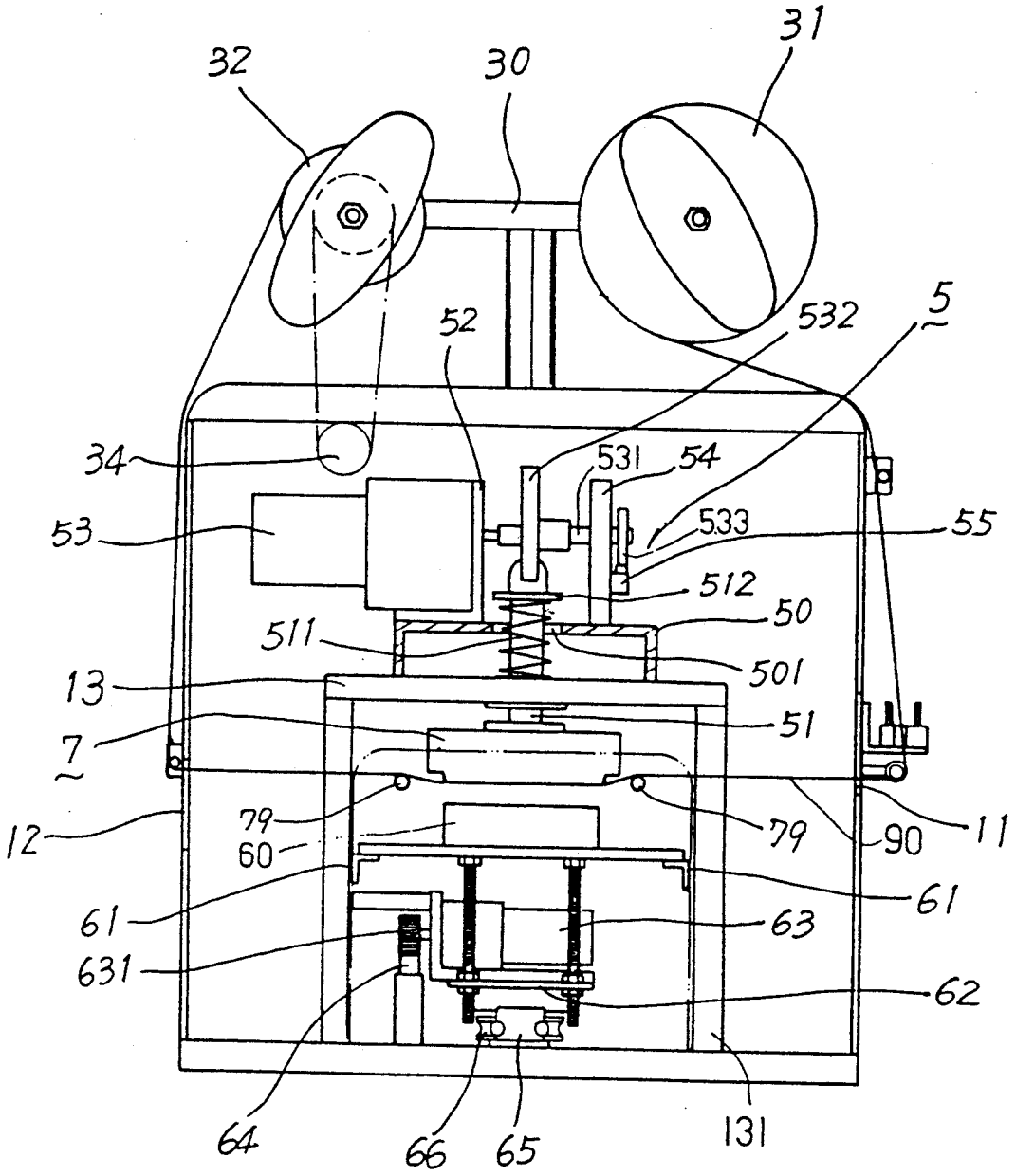
FIG. 2 is a front view of the packaging mechanism, in which, for clarity purposes, part of the outer housing is removed.

Referring to the drawings and initially to FIGS. 1 and 2, a packaging mechanism in accordance with the present invention comprises generally a housing 1 including an opening 10 formed in the front and lower portion thereof, a temperature control board 2 attached to the front portion of the housing 1, a supplying device 3 disposed on top of the housing 1 for supplying membrane or cover layer 90 into the housing 1, a table 60 slidable inwards and outwards of the opening 10 of the housing 1 for supporting a container, such as a cup or a bowl, to be packaged, an actuating device 5 disposed in housing 1, and a pressing device 7 coupled to the actuating device 5 for hot-pressing the membrane 90 on top of the container. The membrane 90 is preferably made of Poly Styrene materials.

The housing 1 includes an inlet 11 and an outlet 12 oppositely formed therein. A platform 13 is disposed in the housing 1. The supplying device 3 includes a bracket 30 fixed on the platform 13 and extended upward beyond the housing 1, a pair of shafts 301, 302 fixed to the bracket 30 and each supporting a spool 31, 32 for supporting the membrane 90 to be fixed on top of the containers, the membrane 90 from the spool 31 entering into the housing 1 via the inlet 11 and leaving the housing 1 via the outlet 12, the membrane 90 then wound on the spool 32, a sprocket 33 fixed on the shaft 302 and coupled to a motor 34 such that the spool 32 can be rotated by the motor 34 and such that the membrane 90 can be caused to move from the spool 31 toward the other spool 32. A detector 4 is fixed beside the inlet 11 and includes a gap 40 formed therein for receiving one edge portion of the membrane 90 in order to detect the existence of the membrane 90. The control board 2 includes a button 20 for adjusting the temperature of the pressing device 7, a button 21 for switching on and off the packaging mechanism, and another button 22 for energizing and operating the actuating device 5.

Figure 3:
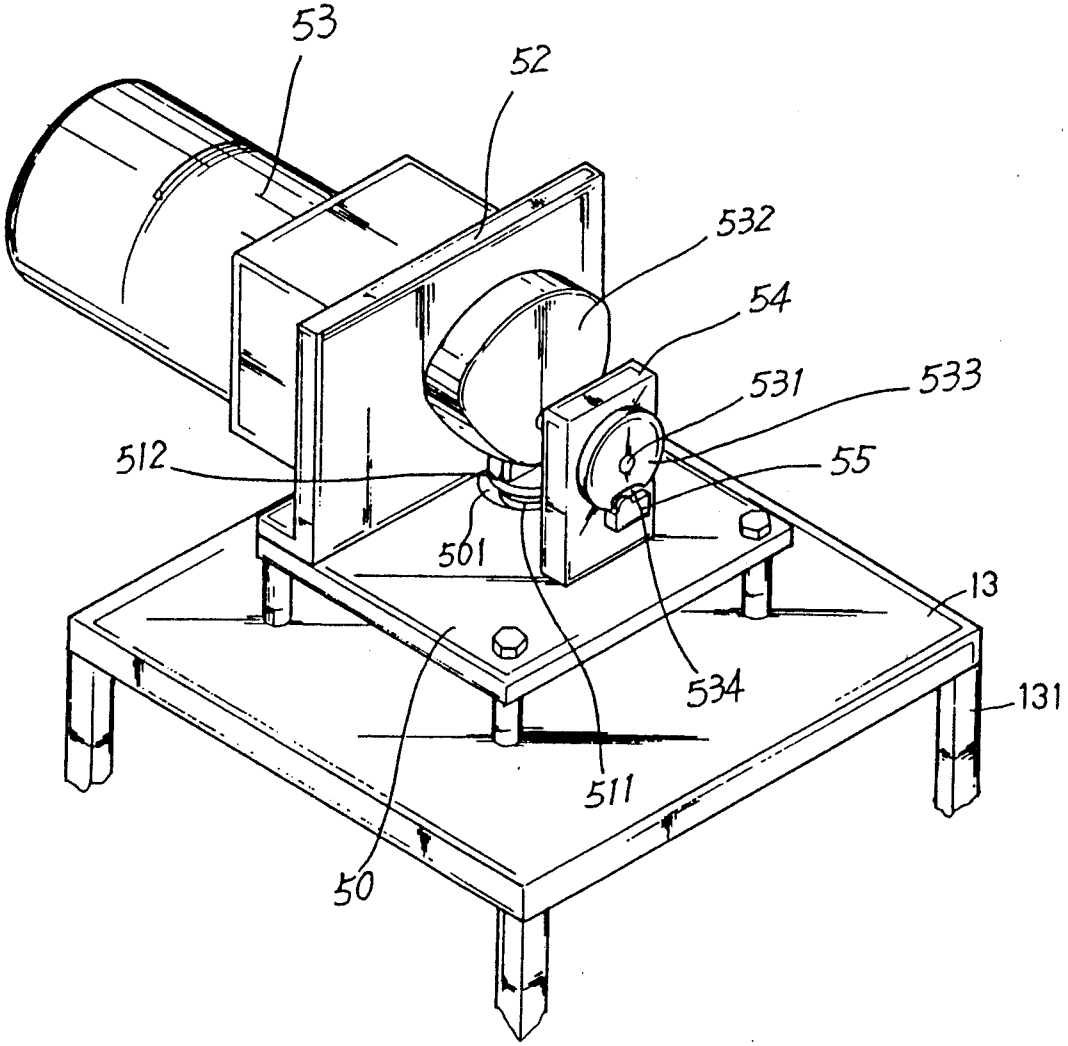
FIG. 3 is a perspective view of a actuating device.

Referring next to FIGS. 3 to 5, and again to FIG. 2, the actuating device 5 includes a plate 50 disposed above the platform 13 and having a hole 501 formed in the center portion thereof, a wall 52 and a bar 54 extended upward from the plate 50, a motor 53 fixed to the wall 52, the motor 53 including a spindle 531 extended through the wall 52 and the bar 54, a cam 532 fixed on the middle portion of the spindle 531, a disc 533 fixed to the free end of the spindle 531 and having a notch 534 formed in the peripheral portion thereof, a microswitch 55 fixed to the bar 54 and engaged in the notch 534 of the disc 533 such that the microswitch 55 can be actuated by the disc 533 when the disc 533 rotates, a rod 51 vertically extended through the platform 13 and the hole 501 of the plate 50 and including an upper end contacted with the cam 532, a flange 512 formed on the upper portion of the rod 51, and a spring 511 biased between the flange 512 of the rod 51 and the platform 13 for biasing the rod 51 upward to engage with the cam 532, such that the rod 51 can be actuated to move up and down by the cam 532. The pressing device 7 is fixed to the lower end of the rod 51. As best shown in FIG. 2, the membrane 90 extends below the pressing device 7 and extends over a pair of guides 79.

Figure 4:
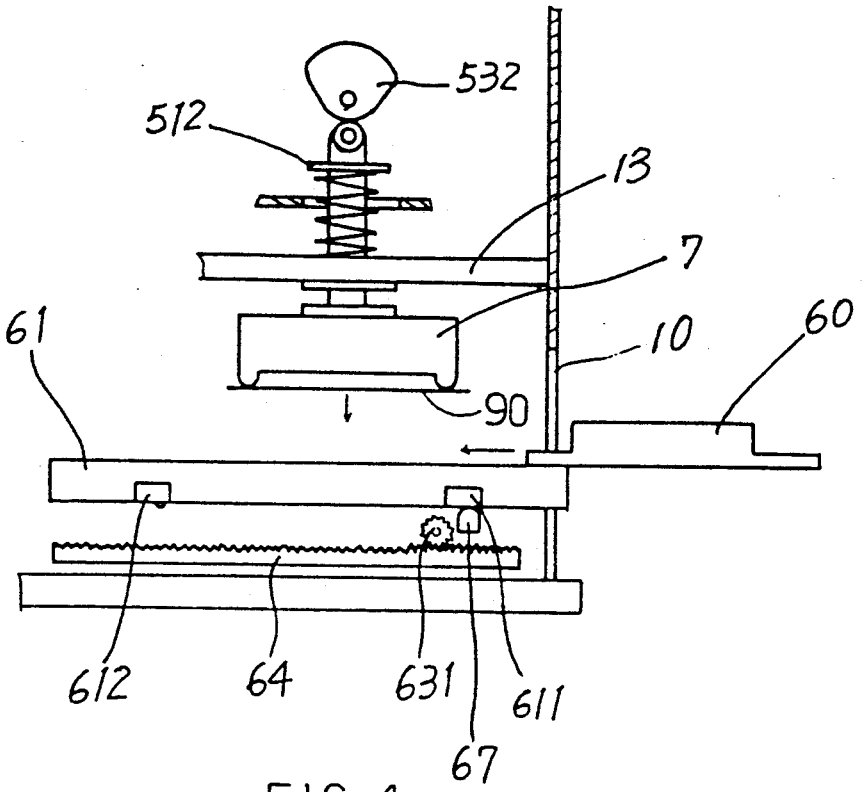
FIGS. 4 and 5 are schematic views illustrating the operations of the actuating device.
Figure 5:
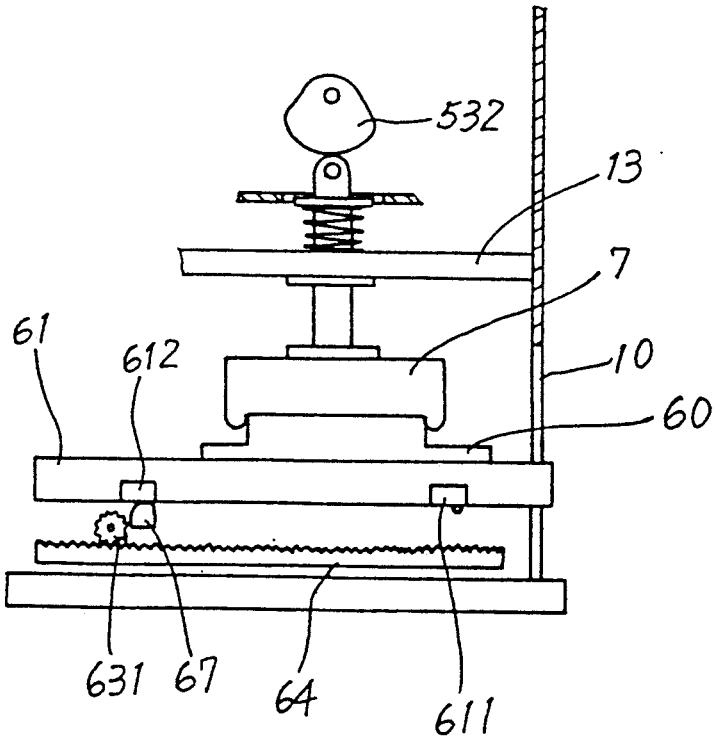

The table 60 is slidably supported on a pair of beams 61 which are fixed to the posts 131 for supporting the platform 13, a carrier 62 is slidably coupled to a track 65 by pulleys 66 such that the carrier 62 is movable along the track 65, the table 60 is fixed to the carrier 62 by bolts, a motor 63 is disposed on the carrier 62 and includes a pinion 631 fixed to the spindle thereof for engagement with a rack 64 which is fixed to the bottom of the housing 1 and which is disposed in parallel to the track 65, such that the carrier 62 and thus the table 60 can be actuated to move along the track 65 by the motor 63. As best shown in FIGS. 4 and 5, two microswitches 611, 612 are disposed in the bottom portion of one of the beams 61, an extension 67 is extended from the carrier 62 for actuating the microswitches 611, 612, such that the movement of the carrier 62 can be controlled.

Referring next to FIG. 7 and again to FIG. 1, the table 60 includes an aperture 605 formed in the center portion thereof for receiving the container 92, and an inner ring 601 and an outer ring 602 extended upward therefrom and arranged such that an annular groove 603 is formed between the rings 601, 602. The container 92 includes an annular flange 920 extended outward from the upper end thereof for engagement with the inner ring 601, such that the container 92 can be retained in place, the membrane 90 will be hot-pressed to the annular flange 920 of the container 92.

Figure 6:
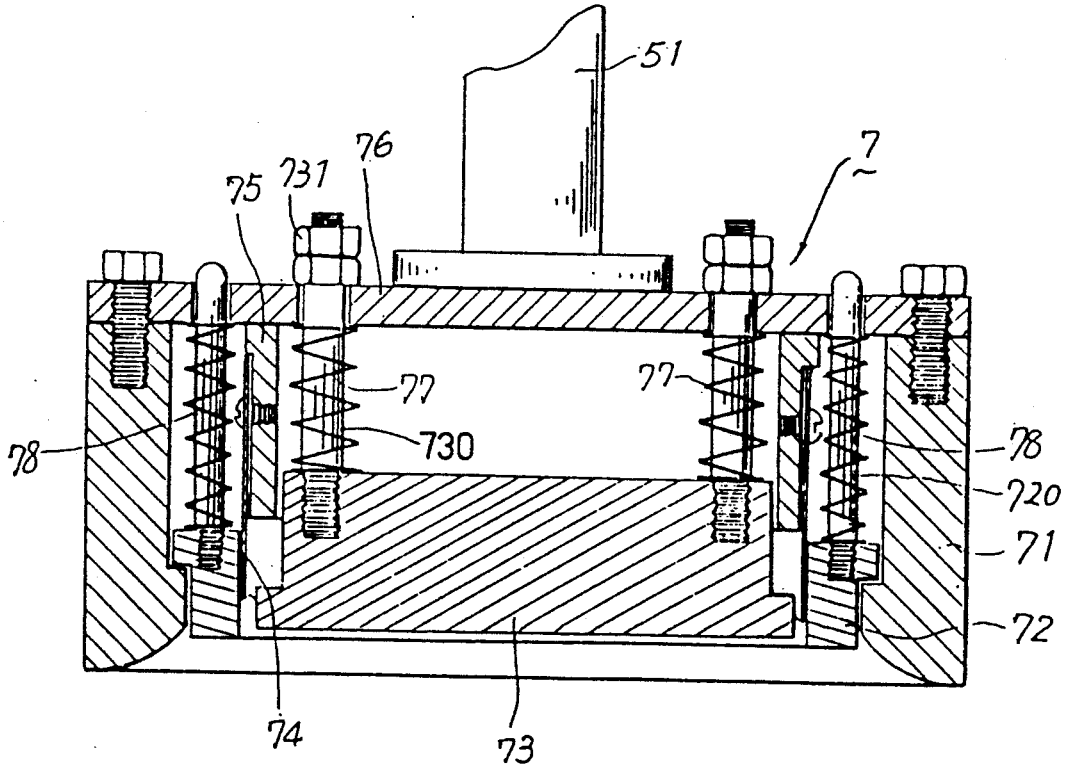
FIGS. 6 and 7 are schematic views illustrating the operations of the pressing device.
Figure 7:
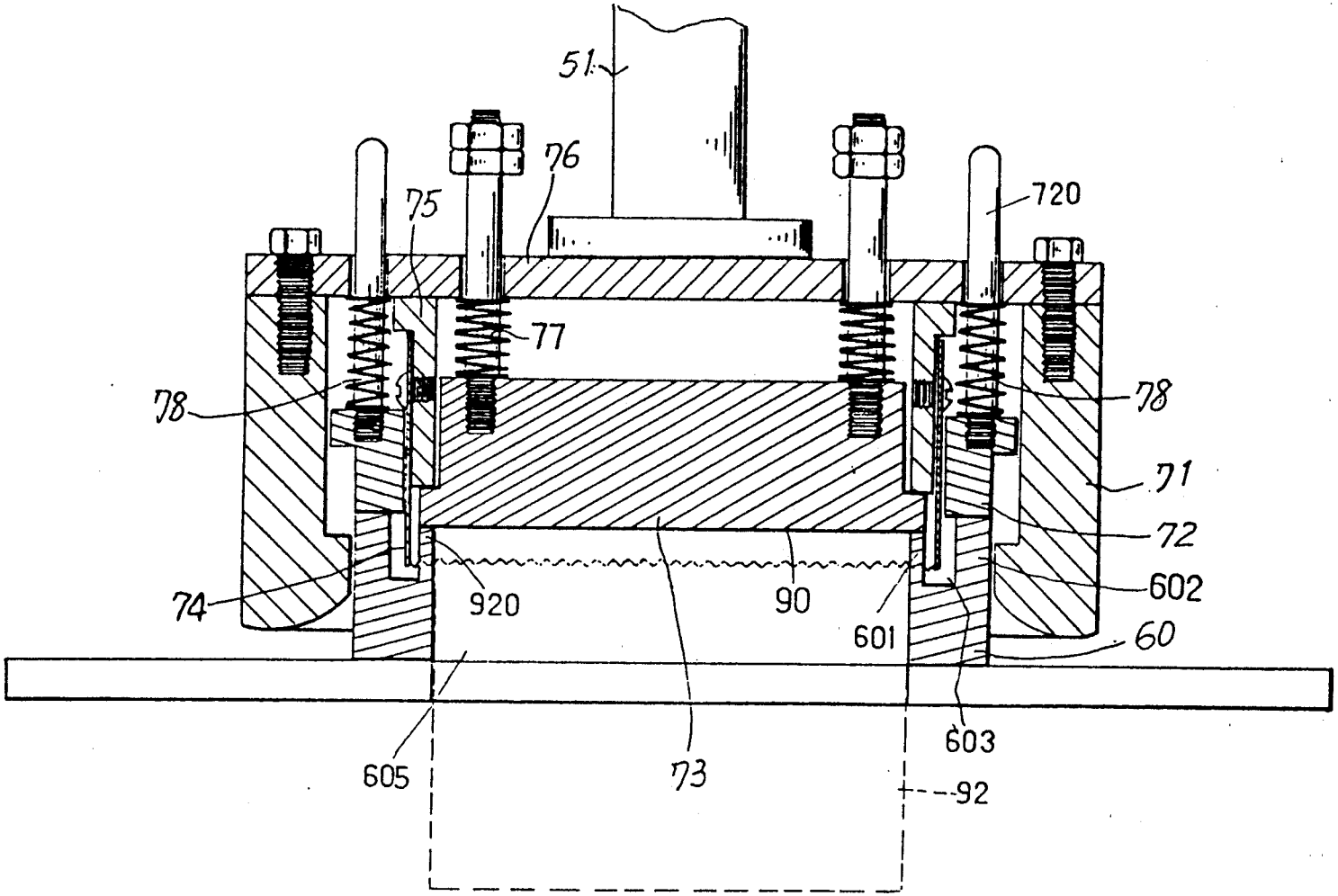

Referring next to FIGS. 6 and 7, the pressing device 7 includes a casing 71 having a top 76 fixed to the lower end of the rod 51, a loop 75 fixed to the top 76, a circular cutting blade 74 fixed to the loop 75 and engageable in the annular groove 603 of the table 60, an annular presser 72 disposed between the casing 71 and the blade 74 and including at least two bolts 720 extended upward through the top 76, a spring 78 engaged on each of the bolts 720 for biasing the presser 72 downward, a board 73 disposed within the blade 74 and including at least two bolts 730 extended upward through the top 76, a spring 77 engaged on each of the bolts 730 for biasing the board 73 downward, at least one nut 731 engaged on the upper end of each of the bolts 730 for limiting the downward movement of the board 73. The board 73 is an electric heater and can be heated to a suitable temperature which is controlled by the temperature control button 20 (FIG. 1). It is to be noted that the presser 72 slightly extends downward beyond the board 73 (FIG. 6), such that the presser 72 is engaged on the outer ring 602 before the board 73 is engaged on the inner ring 601 (FIG. 7)

In operation, a container 92 is disposed in the aperture 605 of the table 60 (FIGS. 1 and 7), the button 22 is then actuated so as to actuate the motor 63 (FIG. 2) in order to move the carrier 62 and the table 60 inwards of the housing 1 until the microswitch 612 is actuated by the extension 67, as shown in FIG. 5, at this moment, the motor 63 is stopped, and the other motor 53 is actuated in order to rotate the cam 532 and in order to depress the rod 51 downward; as shown in FIGS. 6 and 7, the presser 72 is engaged on the outer ring 603 for retaining the membrane 90 in place, the board 73 then moves downward in order to hot-press the membrane 90 to the annular flange 920 of the container 92 so that the container 92 can be suitably sealed, the rod 51 further moves downward such that the blade 74 moves downward beyond the board 73 and is engaged in the annular groove 603 of the table 60 in order to cut the membrane 90.

Figure 8:
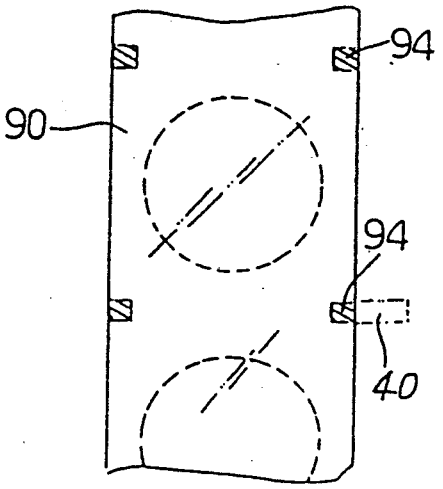
FIG. 8 is a schematic view illustrating the membrane sensing device.

The spindle 531 of the motor 53 rotates until the microswitch 55 is actuated, such that the motor 53 is stopped, and the other motors 34, 63 are actuated in order to feed the membrane 90. As shown in FIG. 8, a plurality of sensing points 94 are disposed along the membrane 90 and are spaced apart with a suitable distance which is determined by the size of the container 92 to be packaged; each time when the sensing points 94 move into the gap 40 of the detector 4, the motor 34 is stopped such that the membrane 90 can be fed with a suitable distance each time. The container 92 after packaging operation can thus sent out by the table 60 and is removed before another container 92 is disposed in the aperture 605 of the table 60.

Accordingly, the containers 92 can be packaged automatically by the packaging mechanism in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A packaging mechanism for sealing a membrane on top of a container comprising a housing including an inlet and an outlet oppositely formed therein, a table disposed in said housing for supporting said container, said membrane entering into said housing via said inlet and leaving said housing via said outlet and located above said container, a hot-pressing means disposed above said container, and means for actuating said hot-pressing means downward and upward in order to depress said membrane downward toward said container whereby said container is hot-pressed to said top of said container when said hot-pressing means moves downward; and wherein said housing includes a platform disposed therein, a bracket fixed on said platform and extended upward beyond said housing, a pair of shafts fixed to said bracket, a spool rotatably disposed on each of said shafts, said membrane including a first end wound on one of said spools and a second end wound on the other of said spools.

2. A packaging mechanism for sealing a membrane on top of a container comprising a housing including an inlet and an outlet oppositely formed therein, a table disposed in said housing for supporting said container, said membrane entering into said housing via said inlet and leaving said housing via said outlet and located above said container, a hot-pressing means disposed above said container, and means for actuating said hot-pressing means downward and upward in order to depress said membrane downward toward said container whereby said container is hot-pressed to said top of said container when said hot-pressing means moves downward; and wherein said housing includes a platform disposed therein, said actuating means includes a rod vertically extended through said platform, means for biasing said rod upward, a motor disposed on said platform and including a spindle, a cam fixed on said spindle and engaged on an upper end of said rod for actuating said rod downward, and said hot-pressing means is fixed to a lower end of said rod.

3. A packaging mechanism for sealing a membrane on top of a container comprising a housing including an inlet and an outlet oppositely formed therein, a table disposed in said housing for supporting said container, said membrane entering into said housing via said inlet and leaving said housing via said outlet and located above said container, a hot-pressing means disposed above said container, and means for actuating said hot-pressing means downward and upward in order to depress said membrane downward toward said container whereby said container is hot-pressed to said top of said container when said hot-pressing means moves downward; and wherein said table includes an inner ring and an outer ring extending upward therefrom, an annular groove formed between said rings, said hot-pressing means includes a casing having a top, a loop fixed to said top, an annular blade fixed to said loop and extendible downward into said annular groove of said table, a presser disposed between said casing and said blade and engageable on said outer ring of said table, and a board disposed in said blade and engageable with said inner ring, and said blade is provided to cut said membrane retained between said presser and said board.

4. A packaging mechanism according to claim 3, wherein said board is a heater.

5. A packaging mechanism according to claim 3, wherein said presser includes at least two bolts extended upward beyond said top of said casing, and means for biasing said presser downwards.

6. A packaging mechanism according to claim 3, wherein said board includes at least two bolts extended upward beyond said top of said casing, and means for biasing said board downwards.

* * * * *